US007789811B2

(12) United States Patent
Cooper

(10) Patent No.: US 7,789,811 B2
(45) Date of Patent: Sep. 7, 2010

(54) METHOD AND APPARATUS FOR A MOBILE TRAINING DEVICE FOR SIMULTANEOUS USE BY MULTIPLE USERS

(76) Inventor: Scott R. Cooper, 10265 W. Patrick La., Peoria, AZ (US) 85383

( * ) Notice: Subject to any disclaimer, the term of this patent is extended or adjusted under 35 U.S.C. 154(b) by 106 days.

(21) Appl. No.: 12/019,207

(22) Filed: Jan. 24, 2008

(65) Prior Publication Data

US 2008/0139367 A1 Jun. 12, 2008

(51) Int. Cl.
*A63B 69/34* (2006.01)
*A63B 69/30* (2006.01)

(52) U.S. Cl. ..... 482/89; 482/83

(58) Field of Classification Search ..... 482/23, 482/33–38, 41–42, 83–90, 111–113
See application file for complete search history.

(56) References Cited

U.S. PATENT DOCUMENTS 1,032,139 A * 7/1912 Hart ..... 482/90
1,142,137 A * 6/1915 Bathrick ..... 482/41
1,928,089 A * 9/1933 Blickman ..... 482/90
2,365,117 A * 12/1944 Stafford et al. ..... 482/37
3,399,891 A * 9/1968 McCormick et al. ..... 473/442
3,424,458 A * 1/1969 Hopps, Jr. ..... 473/443
3,850,428 A * 11/1974 Zuber ..... 482/36
4,019,734 A 4/1977 Lee
4,046,373 A 9/1977 Kim
4,084,812 A * 4/1978 Melrose et al. ..... 472/118
4,103,889 A 8/1978 Lobur
4,126,308 A 11/1978 Crumley
4,173,336 A 11/1979 Perry
4,216,957 A * 8/1980 Curatola ..... 482/90
4,241,915 A 12/1980 Noble
4,309,028 A 1/1982 Finizza
4,403,772 A 9/1983 Stangle
4,441,707 A 4/1984 Bosch
4,445,684 A 5/1984 Ruff
4,491,316 A 1/1985 Prince
4,540,173 A 9/1985 Hopkins, Jr.
4,557,478 A 12/1985 Levine
4,572,504 A 2/1986 DiBartolo
4,583,730 A 4/1986 Gecht
4,635,929 A 1/1987 Shustack
4,667,954 A 5/1987 McCorkle
4,685,671 A 8/1987 Hagerman
4,732,378 A 3/1988 LeFebvre
4,749,184 A 6/1988 Tobin
4,757,989 A 7/1988 Bauer, Jr.

(Continued)

*Primary Examiner*—Loan Thanh
*Assistant Examiner*—Daniel F Roland

(57) ABSTRACT

A method and apparatus for a physical training device is provided to accommodate one or more athletes during support of a plurality of independent training scenarios for each athlete. The physical training device provides a plurality of training stations, where each training station may be specific to martial arts training activities, or may be generalized to facilitate training that is effective for a plurality of other sporting disciplines. The physical training device provides removable casters that facilitate maneuvering and reconfiguration of the physical training device. Lifting devices may also be configured along the bottom surface of the physical training device so as to provide a mechanism whereby the casters of the physical training device may be lifted off of the surface that is supporting the casters. Two or more physical training devices may be interconnected so as to provide a localized cluster of physical training devices.

16 Claims, 10 Drawing Sheets

U.S. PATENT DOCUMENTS 4,789,152 A * 12/1988 Guerra ..... 482/142
4,807,871 A * 2/1989 Bryson ..... 482/83
4,826,151 A 5/1989 Nuredin
4,826,153 A 5/1989 Schalip
4,826,158 A 5/1989 Fields
4,889,334 A 12/1989 Partlo
4,973,045 A 11/1990 Heberer
5,005,832 A 4/1991 Van Der Hoeven
5,042,800 A 8/1991 Walter
5,151,072 A * 9/1992 Cone et al. ..... 482/104
5,152,732 A 10/1992 Sayre
5,195,938 A 3/1993 Robertson
5,232,368 A 8/1993 Morgia
5,277,683 A 1/1994 Wilkins
5,322,493 A 6/1994 Venner
5,324,245 A 6/1994 Fontana
5,362,295 A 11/1994 Nurge
5,389,057 A 2/1995 Zagata, Jr.
5,413,548 A 5/1995 Hoffman
5,415,371 A 5/1995 Kirchner
5,472,395 A * 12/1995 Trocchio ..... 482/83
5,476,433 A 12/1995 Bruner
5,476,435 A 12/1995 Nimmo
5,501,649 A 3/1996 Queppet
5,503,606 A * 4/1996 Stephens ..... 482/7
5,554,088 A 9/1996 Zlojutro
5,607,377 A 3/1997 Wilkinson
5,611,760 A * 3/1997 Jordan ..... 482/83
5,624,360 A 4/1997 Wilkins
5,658,222 A 8/1997 Brown
5,662,555 A 9/1997 Cloutier
5,665,035 A 9/1997 Tumminia
5,674,157 A 10/1997 Wilkinson
5,707,324 A 1/1998 Blake
5,755,641 A * 5/1998 Pardella ..... 482/36
5,800,319 A 9/1998 Choate
5,813,955 A 9/1998 Gutkowski
5,863,278 A 1/1999 Chen et al.
5,902,217 A 5/1999 Schechner
5,921,895 A 7/1999 Lynch
5,941,801 A 8/1999 D'Alto
5,944,639 A 8/1999 Ray
6,063,011 A 5/2000 Pelchat
6,117,054 A * 9/2000 Soltanpour ..... 482/83
6,149,553 A 11/2000 Antoszewski
6,152,863 A * 11/2000 Nelson et al. ..... 482/83
6,217,490 B1 4/2001 Wurtak
6,220,992 B1 * 4/2001 Shafik ..... 482/83
6,394,932 B1 * 5/2002 Chu ..... 482/38
6,398,697 B1 6/2002 Nichols, Jr.
6,416,445 B1 * 7/2002 Nelson et al. ..... 482/83
6,432,027 B1 8/2002 Haselrig
6,530,867 B2 * 3/2003 Schwendemann ..... 482/83
6,540,651 B1 4/2003 Aberton
6,554,747 B1 4/2003 Rempe
6,656,094 B2 12/2003 Rigas
6,659,913 B2 * 12/2003 Johnston et al. ..... 482/8
6,685,601 B1 * 2/2004 Knapp ..... 482/104
6,872,171 B2 3/2005 Haselrig
6,896,642 B1 5/2005 Brown
6,976,945 B1 * 12/2005 Lim ..... 482/148
6,994,655 B2 * 2/2006 Chu ..... 482/38
7,022,054 B2 4/2006 Contreras
7,070,167 B1 * 7/2006 Bacon et al. ..... 254/93 HP
7,172,535 B2 * 2/2007 Volmar ..... 482/101
7,309,303 B1 * 12/2007 Proctor ..... 482/121
2004/0110607 A1 * 6/2004 Crespo ..... 482/89
2004/0264098 A1 12/2004 Eccles
2005/0227825 A1 * 10/2005 Kutov ..... 482/83
2005/0233875 A1 10/2005 Clarke
2006/0025284 A1 2/2006 Livingstone et al.
2006/0058164 A1 * 3/2006 Miller et al. ..... 482/87
2006/0160682 A1 7/2006 Maloy
2006/0194675 A1 * 8/2006 Valentine ..... 482/83
2008/0220949 A1 * 9/2008 Yang ..... 482/90

* cited by examiner

METHOD AND APPARATUS FOR A MOBILE TRAINING DEVICE FOR SIMULTANEOUS USE BY MULTIPLE USERS

FIELD OF THE INVENTION

The present invention generally relates to training devices, and more particularly to mobile training devices for simultaneous use by multiple users.

BACKGROUND OF THE INVENTION

Physical exercise is an important activity undertaken by many individuals to maintain their physical fitness. It has been shown, for example, that physical fitness contributes positively toward maintaining healthy body weight; building and maintaining healthy bone density, muscle strength, and joint mobility; promoting physiological well-being; reducing surgical risks; and strengthening the immune system.

Many physical exercise activities, however, such as running, mountain climbing, skiing, etc., require the correct outdoor terrain to support such activities. As such, many outdoor activities do not lend themselves conveniently for physical exercise. Thus, many individuals utilize indoor facilities instead, which offer specialized exercise equipment that may be accessed much more readily.

Public fitness centers, for example, offer a wide variety of exercise equipment within a relatively small proximity. As such, each individual may obtain convenient access to a piece of cardiovascular exercise equipment, for example, while maintaining close proximity access to other specialized fitness equipment, such as strength training equipment.

In many instances, however, athletes that require specialized fitness equipment, such as martial arts athletes, cannot find equipment within the public fitness centers that is suitable for martial arts training. As such, martial arts athletes are often required to provide their own specialized training equipment and are then relegated to train at locations such as gymnasiums, garages, rented or private facilities, parks, backyards, beaches, etc.

Martial arts athletes that train in such facilities, therefore, are often required to temporarily assemble the specialized training equipment in order to support the plurality of workout regimes that may be utilized by a typical group of martial arts athletes. The temporary accommodations are adequate, but generally require disassembly of the specialized training equipment once the workout regimes have been completed. Thus, valuable time and effort is wasted during setup/teardown of the temporary training equipment.

In addition, given that the equipment is setup for temporary use, the equipment often exhibits less than optimum structural integrity. Thus, a first martial arts athlete is often required to stabilize the equipment, while a second martial arts athlete executes the workout regime on the temporarily stabilized equipment. As such, workout efficiency is significantly reduced because the first and second athletes must switch positions after the first athlete completes the workout regime, which essentially doubles the amount of time required for two athletes to achieve a complete workout.

Furthermore, the temporarily deployed training equipment is often utilized within a gymnasium, or other facility, in support of martial arts competitions. As such, the training equipment is deployed during, e.g., warm-up or exhibition exercises, but is then required to be disassembled, relocated, and then reassembled in another area within the gymnasium in support of other competition activities. The lack of mobility offered by conventional training equipment is, therefore, another source of time inefficiency, since teardown/setup activities must be executed each time the training equipment is to be relocated.

Efforts continue, therefore, to develop a training solution that not only offers a full complement of physical training equipment, but also provides mobility for a relocatable solution that facilitates multiple exercise positions simultaneously.

SUMMARY OF THE INVENTION

To overcome limitations in the prior art, and to overcome other limitations that will become apparent upon reading and understanding the present specification, various embodiments of the present invention disclose a method and apparatus that provides a full complement of specialized martial arts equipment and/or generalized physical exercise equipment. The method and apparatus of the present invention also provides mobility for a relocatable training apparatus that facilitates multiple exercise/workout positions simultaneously.

In accordance with one embodiment of the invention, a physical training device comprises a pair of longitudinal frame members, a first pair of vertical frame members having a first end that is coupled to a first end of the pair of longitudinal frame members and a second pair of vertical frame members having a first end that is coupled to a second end of the pair of longitudinal frame members. The physical training device further comprises a first plurality of workout stations that are slidably coupled to the first and second pair of vertical frame members and a second plurality of workout stations that are slidably coupled to the pair of longitudinal frame members. The physical training device further comprises a first lateral frame member having a first surface that is coupled to a second end of the first pair of vertical frame members and a second lateral frame member having a first surface that is coupled to a second end of the second pair of vertical frame members. The physical training device further comprises a mobility device that is coupled to each end of the first and second lateral frame members.

In accordance with another embodiment of the invention, a cluster of physical training devices comprises a cage and a plurality of physical training devices that are coupled to the cage. Each of the plurality of physical training devices comprises a pair of longitudinal frame members, a first pair of vertical frame members having a first end that is coupled to a first end of the pair of longitudinal frame members and a second pair of vertical frame members having a first end that is coupled to a second end of the pair of longitudinal frame members. Each of the plurality of physical training devices further comprising a first plurality of workout stations that are slidably coupled to the first and second pair of vertical frame members and a second plurality of workout stations that are slidably coupled to the pair of longitudinal frame members. Each of the plurality of physical training devices further comprising a first lateral frame member having a first surface that is coupled to a second end of the first pair of vertical frame members and a second lateral frame member having a first surface that is coupled to a second end of the second pair of vertical frame members.

In accordance with another embodiment of the invention, a method of utilizing at least one physical training device comprises slidably configuring a position of one or more workout stations on the at least one physical training device, engaging mobility devices of the at least one physical training device to deploy the at least one physical training device to a desired location, disengaging the mobility devices of the at least one physical training device to stabilize the at least one physical training device at the desired location, and executing one or more workout scenarios on the at least one physical training device at the desired location.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
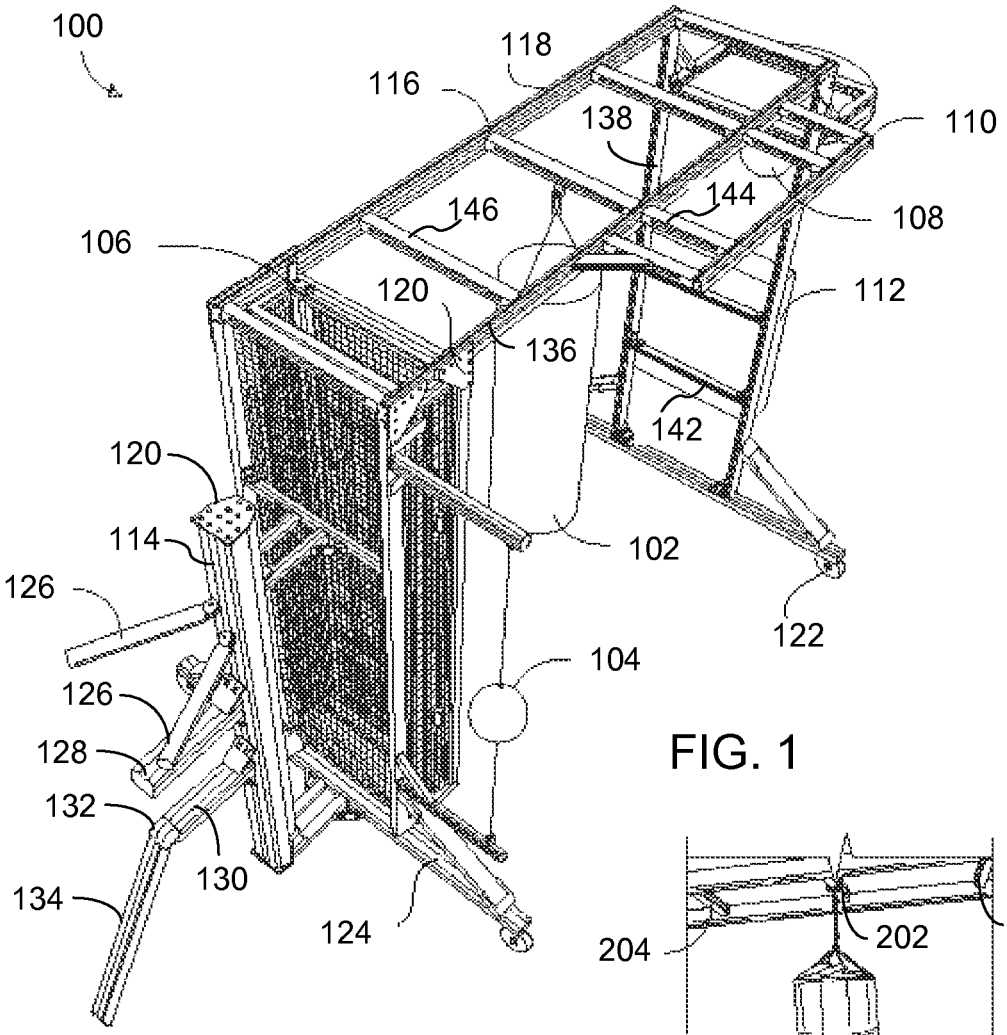
FIG. 1 illustrates a physical training device in accordance with one embodiment of the present invention.

Generally, various embodiments of the present invention are applied to the field of physical training devices. In particular, physical training devices are provided to accommodate one or more athletes during support of a plurality of independent training scenarios for each athlete. In one embodiment, the physical training device provides a plurality of training stations, where each training station may be specific to martial arts training activities, or may be generalized to facilitate training that is effective for a plurality of other sporting disciplines. Each training station may then be utilized by a single athlete, so that independent training regimes may be executed simultaneously for each athlete that occupies a training station. Once each athlete completes a training scenario at a particular workout station, each athlete may then rotate to the next respective workout station existing on the physical training device to complete the training scenario on the next workout station.

By accommodating multiple workout stations within a single physical training device, each athlete is allowed to focus on his or her own workout scenario, without having to provide support to other athletes during their respective workout scenarios. That is to say, in other words, that the physical training device provides a sufficient number of workout stations with a high degree of structural integrity, so that multiple athletes may execute individual workout scenarios simultaneously. Once specific activities during a first portion of the specific workout regime have been completed, each athlete may rotate his or her position relative to the physical training device, so as to execute a subsequent portion of the specific workout regime. Completion of subsequent rotations is effective to provide each athlete with a complete workout according to his or her workout regime, without additionally requiring each athlete to provide support activities for other athletes. As such, each athlete maximizes his or her workout efficiency during his or her workout regime.

In addition, the physical training device provides mobility features that facilitate maneuvering and reconfiguration of the physical training device. In one embodiment, for example, removable casters are provided at a bottom surface of the physical training device, so as to allow relocation and reconfiguration of the physical training device during, e.g., training or exhibition events. The removable casters may be composed of a sufficiently rigid material and appropriately sized so as to facilitate movement of the physical training device across a relatively hard and flat surface, such as a gymnasium floor. In an alternate embodiment, the removable casters may be composed of a sufficiently flexible material and appropriately sized so as to facilitate movement of the physical training device across a substantially non-flat and soft surface, such as a sandy beach. In such an instance, the casters may be implemented with an inflatable rubber material, so as to further enhance traversal over soft terrain.

Lifting devices may also be configured along the bottom surface of the physical training device, so as to provide a mechanism whereby the casters of the physical training device may be lifted off of the surface that is supporting the casters. In one embodiment, pneumatically controlled lifting devices may be actuated so as to elevate the casters just above the supporting surface. In such an instance, the pneumatically controlled lifting devices may function as stationary platforms for the physical training device during a training or exhibition event while the pneumatically controlled lifting devices remain in their fully deployed positions. The pneumatically controlled lifting devices may be activated and deactivated via any convenient actuation device, such as a manual switch or remote control, so as to maximize convenience.

In an alternate embodiment, the casters may either be removed, or installed in an inverted position, while the pneumatically controlled lifting devices are fully deployed. The pneumatically controlled lifting devices may then be deactivated to a fully retracted position while functioning as stationary platforms for the physical training device during the training or exhibition event. In other embodiments, the pneumatically controlled lifting devices may remain in their fully retracted positions while the casters function as stationary platforms for the physical training device during the training or exhibition event. In such an instance, the casters may be locked so as to prevent rotation of the casters.

In accordance with one embodiment, the physical training device may be utilized in a stand-alone configuration. As such, the number of athletes that may be simultaneously accommodated by the stand-alone configuration is equal to the number of workout stations provided by the physical training device. As discussed in more detail below, the physical training station may include a multitude of workout stations, such as: one or more speed-bag stations; one or more speed-ball stations; one or more heavy punching bag stations; one or more pull-up bar stations; a Wing Chun station; a monkey-bar station; a body-shield station; and a board breaking station to name only a few.

Each physical training device may also include features such as an equipment storage cage, whereby in one embodiment, martial arts weapons and equipment, such as swords, nunchucks, throwing stars, fighting gloves, etc., may be stored during non-use. The equipment storage cage may also feature a locking mechanism, so that the physical training device may be left unattended without risk of uninvited access to the contents of the equipment storage cage. A media center may also be provided by the physical training device, so as to facilitate audio/video instruction during execution of the one or more workout scenarios.

In accordance with an alternate embodiment, two or more physical training devices may be interconnected, so as to provide a localized cluster of physical training devices. In such an instance, the number of athletes that may be simultaneously accommodated by the cluster configuration is equal to the combined number of workout stations that are provided by all of the physical training devices interconnected within the cluster.

As discussed in more detail below, the cluster configuration may be facilitated through the use of an exhibition cage, whereby each physical training device is interconnected to a respective supporting member of the exhibition cage. In such an instance, a plurality of workout scenarios may be facilitated by the two or more physical training devices that are interconnected to an exterior region, as defined by the exhibition cage, while an exhibition or competition match is facilitated within an interior region as defined by the exhibition cage. In other embodiments, a cluster of physical training devices may be arranged without the need for the exhibition cage, whereby each stand-alone physical training device is situated in close proximity to other physical training devices in accordance with the particular training scenario that is desired.

Turning to FIG. 1, physical training device 100 exhibiting a plurality of workout stations is illustrated in accordance with one embodiment of the present invention. In particular, workout stations provided by physical training device 100 include heavy punching bag station 102, speed-ball station 104, speed-bag station 108, pull-up bar station 110, body-shield station 112, Wing Chun station 114, and monkey-bar station 116. It should be noted that the relative placement of each workout station is configurable. Thus, the stand-alone configuration of FIG. 1 is representative of only one of many possible configurations that may be employed.

Figure 2:
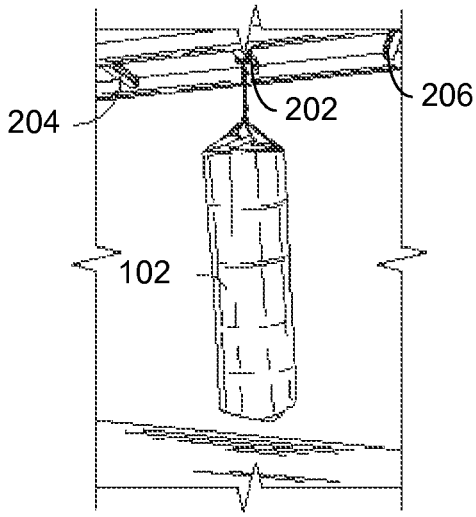
FIG. 2 illustrates relocation details of one of many workout stations of a physical training device in accordance with one embodiment of the present invention.

An alternate configuration, for example, may include the relocation of heavy punching bag station 102 from lateral bar 202 of monkey-bar station 116, as illustrated in FIG. 2, to one of the remaining lateral bars of monkey-bar station 116, e.g., lateral bar 204 or 206. Alternately, heavy punching bag station 102 may instead be configured on either side of monkey-bar station 116 along longitudinal frame member 118 or longitudinal frame member 136. Similarly, pull-up bar station 110 may be positioned along longitudinal frame member 136 closer to speed-bag station 108 and body-shield station 112, as illustrated. Pull-up bar station 110 may also be centered along longitudinal frame member 136, or conversely, positioned along longitudinal frame member 136 closer to speed-ball station 104 and equipment cage 106. In alternate embodiments, as discussed below in relation to FIG. 8 for example, multiple pull-up bar stations 110 may be positioned along longitudinal frame member 118 and longitudinal frame member 136 so as to accommodate multiple athletes who wish to simultaneously execute their respective workout scenarios on pull-up bar stations 110.

Figure 3D:
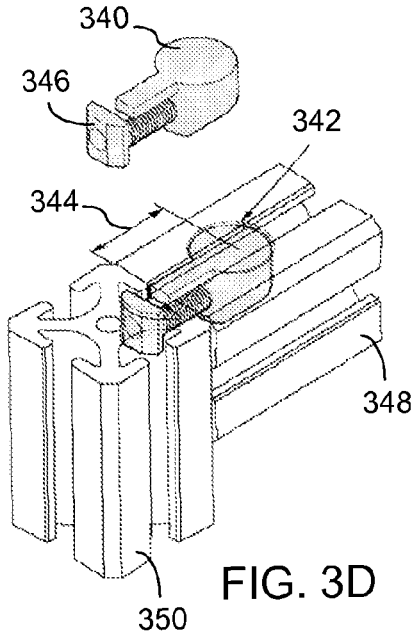
FIGS. 3B-3D illustrate various fastening and safety mechanisms that may be utilized on the frame arrangement of FIG. 3A.
Figure 3B:
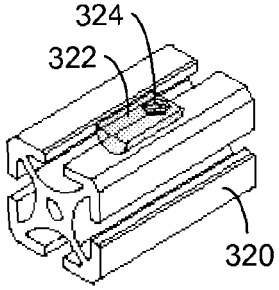
Figure 3C:
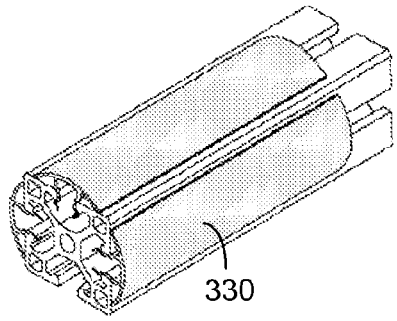
Figure 3A:
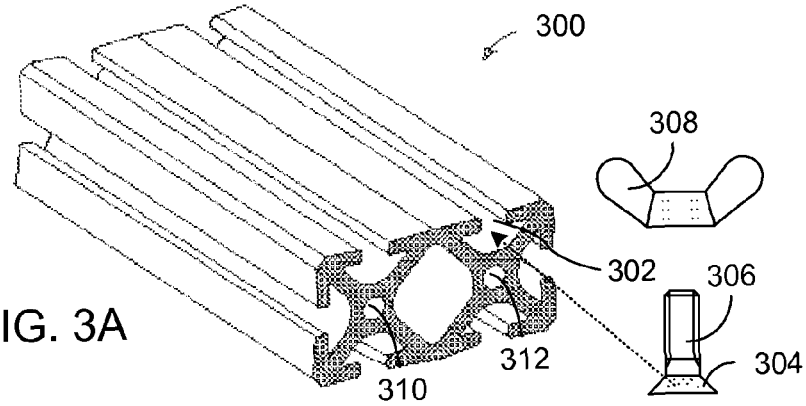
FIG. 3A illustrates a frame arrangement used to implement the frame members of a physical training device in accordance with one embodiment of the present invention.

Turning to FIG. 3A, one embodiment of frame arrangement 300 that may be used to implement the various frame members of the physical training device is illustrated. Frame arrangement 300 is implemented as a rigid structure, such as an extruded aluminum structure, that provides channels 302 and hollow portions 310 and 312. Channels 302 may be implemented on all four sides of frame arrangement 300 as illustrated, so as to provide, for example, six channels for each frame member. Hollow portions 310 and 312, as discussed in more detail below, facilitate the attachment of utility devices, such as casters 122, to the end points of lateral frame members 124 as shown, for example, in the physical training devices of FIGS. 1 and 8.

Channels 302 are configured to accept a multitude of fastening systems, such as the combination of screw 306 and wingnut 308. In particular, head portion 304 aligns with channels 302, so that insertion of head portion 304 into channel 302 at the end points of frame arrangement 300 allows screw 306 to be slidably positioned along the length of frame arrangement 300. Once an adequate position of screw 306 along the length of frame arrangement 300 is located, wing nut 308 may be threaded onto screw 306 and tightened so as to prevent further repositioning of screw 306.

Alternate fastening systems, such as illustrated in FIG. 3B, may also be utilized in much the same manner. Fastener 322 may be inserted into the channel of frame member 320 as illustrated and subsequently tightened into place using a set screw (not shown) that is mechanically fastened to threaded receiver portion 324. Fastener 322 may be slidably positioned along the channel of frame member 320 so as to accommodate the configurable fastening of workout stations along the full length of frame member 320 as required.

Ergonomic aspects may also be incorporated along frame arrangement 300 as well as illustrated in FIG. 3C. For example, hand guards 330 may be mounted to one or more sides of frame arrangement 300 so as to facilitate a smooth grip while an athlete is executing his or her workout scenario while using, e.g., monkey-bar station 116 of FIG. 1. In one embodiment, hand guards 330 may be composed of a rigid plastic material, such as polyvinyl chloride (PVC), and coated with an ultraviolet light protectant for outdoor use. Similar PVC guards may also be utilized to provide safety aspects to the physical training device. In particular, PVC guards 330 may be mounted to each frame member to create a smooth, rounded contour on each side of the frame member so as to reduce the incidence of injury in the event physical contact is made between the athletes and the frame members.

Turning to FIG. 3D, mounting anchors 340 may be utilized at each end of frame members 348 to facilitate mechanical engagement of frame member 348 to frame member 350. In particular, mounting anchors 340 may be utilized to facilitate the mechanical engagement of one frame member that is orthogonally incident to another frame member. Locking member 346 may be inserted into channel 302 of frame member 350 while anchor 340 is inserted into slot 342 of frame member 348. Locking member 346 and anchor 340 may then be mechanically engaged/disengaged in direction 344 as necessary to secure/loosen the mechanical engagement between frame members 348 and 350 as necessary.

Turning back to FIG. 1, lateral frame members 144 of pull-up bar station 110, for example, may be slidably attached to longitudinal frame member 136 using the fastening system as discussed above in relation to FIG. 3D. As such, the position of pull-up bar station 110 along the full length of longitudinal frame member 136 may be selected and then secured by the tightening of anchor 340 and locking mechanism 346. Similarly, lateral frame members 146 of monkey-bar station 116 may be slidably attached to longitudinal frame members 118 and 136 using a similar combination of fastening systems to configure the separation distance between each of lateral frame members 146 of monkey-bar station 116. In an alternate embodiment, lateral frame members 146 of monkey-bar station 116 may instead be permanently mounted to longitudinal frame members 116 and 136 using any number of mechanical fastening mechanisms, such as TIG welding, to permanently select the separation distance between each of lateral frame members 146.

Figure 4:
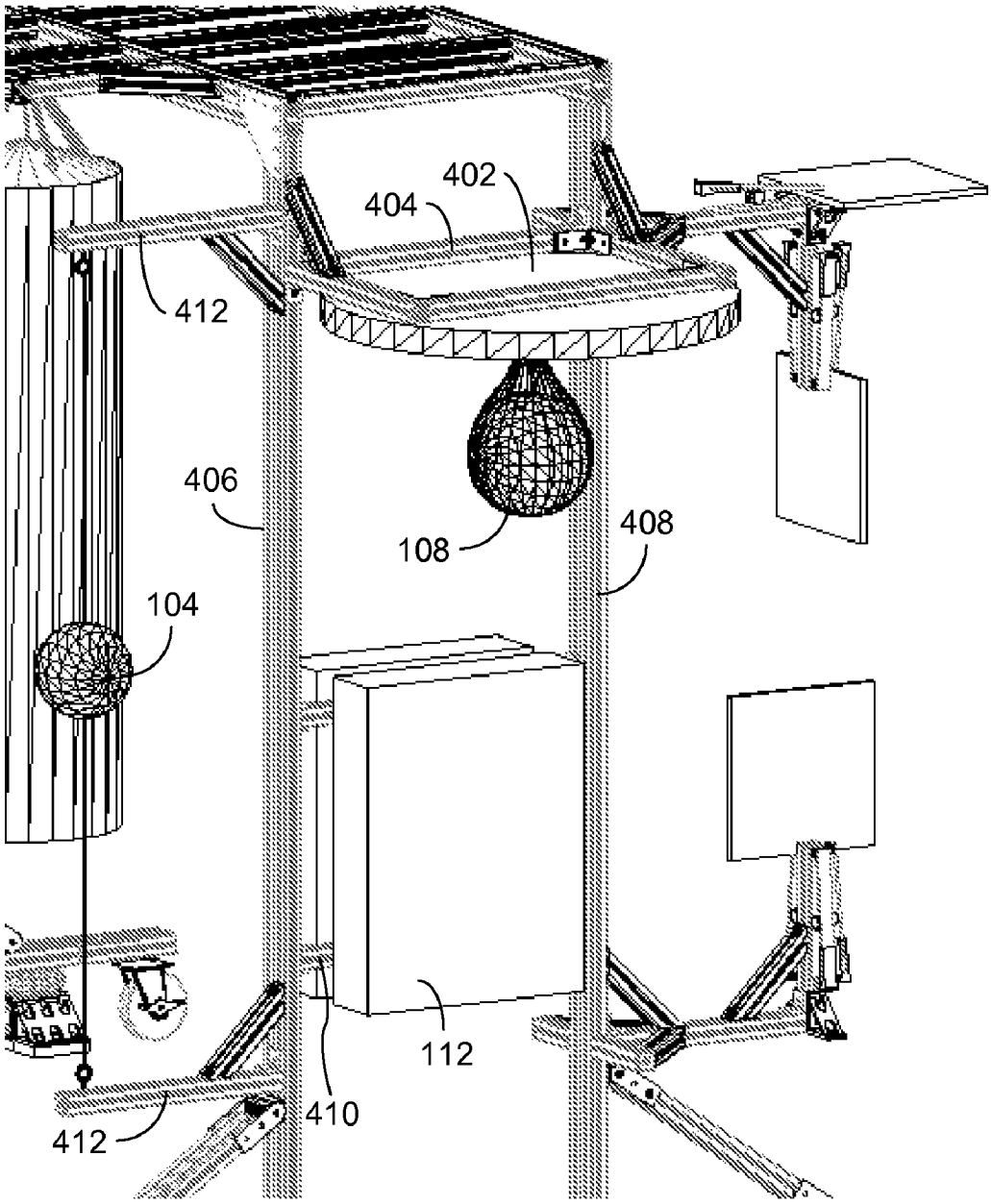
FIG. 4 illustrates mechanical engagement details of various workout stations of a physical training device in accordance with various embodiments of the present invention.

The use of slidably attached mechanisms to adjoin two or more intersecting frame members and the attachment of the various workout stations to one of the intersecting frame member sets facilitates the correct positioning of the various workout stations of the physical training device. Turning to FIG. 4, for example, support platform 402 of speed-bag station 108 may be slidably attached to vertical frame members 406 and 408, using mounting brackets 404 and the fastening systems discussed above, so as to select the correct height of speed-bag station 108. Support platform 410 of body-shield station 112, as well as support platform 412 of speed-ball station 104, may also be slidably attached to their respective frame members so as to properly adjust their height as well.

Turning back to FIG. 1, individual components of each workout station may be repositioned to accommodate differently sized athletes. Wing Chun station 114, for example, provides height adjustable components, such as one or more arm components 126, a mid-section component 128, and a leg component that contains various sub-components, such as upper leg component 130, joint component 132, and lower leg component 134. Each component 126-136, for example, is height adjustable using slidably attached mechanisms as discussed above in relation to FIGS. 3A, 3B, and 3D. As such, correct vertical positioning of each component may be adjusted in accordance with the height of a particular martial arts athlete, so as to facilitate the proper execution of the martial art of Wing Chun, to include facilitation of the hand and footwork techniques that are incorporated into the martial art of Wing Chun.

Figure 5:
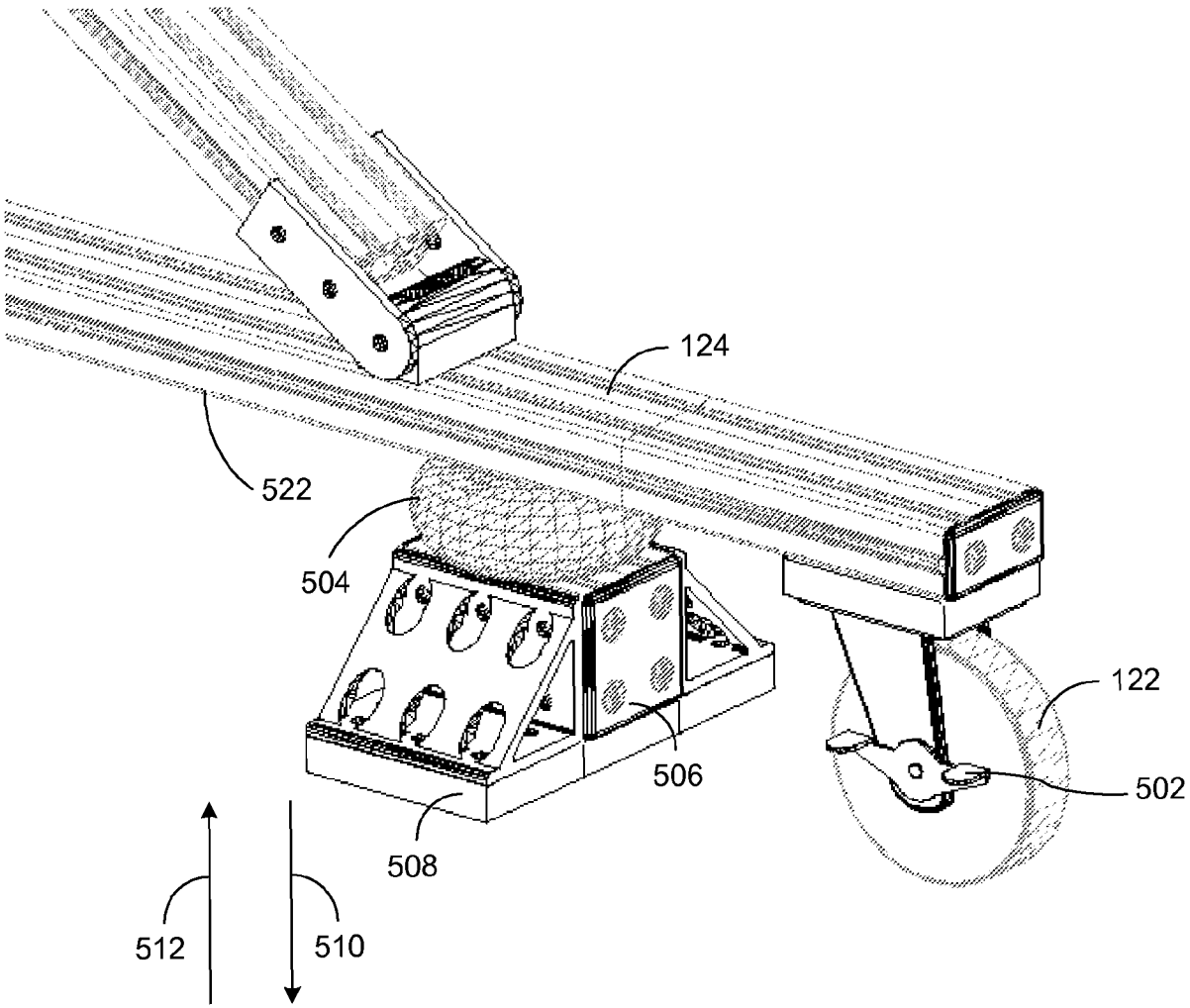
FIG. 5 illustrates additional mechanical details of a physical training device in accordance with various embodiments of the present invention.

Turning to FIG. 5, additional mechanical aspects of a physical training device are illustrated. In particular, one of several casters 122 may provide locking mechanism 502, which is engaged to prevent rotation of caster 122 along the associated supporting surface, when casters 122 are utilized to provide stationary platforms for the physical training device. Locking mechanism 502 may alternately be disengaged when casters 122 are utilized to provide mobility for the physical training device.

Lifting devices may also be configured along bottom surface 522 of, e.g., lateral frame members 124, so as to provide a mechanism whereby casters 122 of the physical training device may be lifted off the supporting surface for the physical training device. In particular, pneumatically controlled lifting devices, such as pneumatic discs 504, may be actuated so as to elevate casters 122 to a position that is just above the supporting surface. In such an instance, pneumatic discs 504 are inflated until supporting members 506 and 508 engage the supporting surface, so as to elevate caster 122 in direction 512 relative to the supporting surface. In such an instance, supporting members 506 and 508 function as stationary platforms for the physical training device during a training or exhibition event while pneumatic disks 504 remain in their fully deployed positions.

Figure 6B:
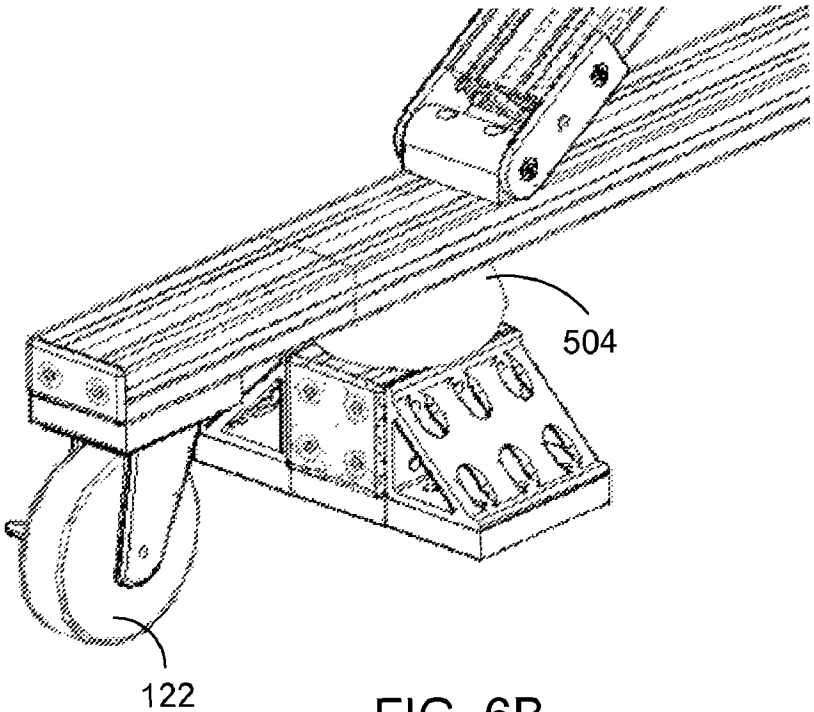
FIGS. 6A-6B illustrate mechanical details of the removable casters of a physical training device in accordance with one embodiment of the present invention.
Figure 6A:
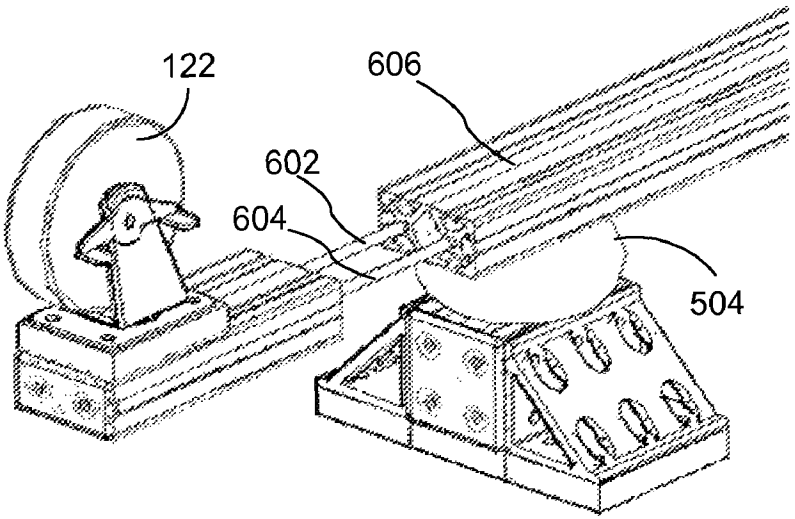

In an alternate embodiment, casters 122 may either be removed, installed in an inverted position, or left in a mobility configuration while pneumatic disks 504 are fully deployed. Turning to FIGS. 6A and 6B, for example, mechanisms allowing the mounting and removal of casters 122 are illustrated. As discussed above in relation to FIG. 3A, lateral frame members 124 may be comprised of frame arrangement 300 having hollow portions 310 and 312. Pins 602 and 604 may then be inserted into hollow portions 310 and 312 of frame members 124 so as to facilitate mounting of casters 122 in the mobility configuration as illustrated is FIG. 6B. Alternately, casters 122 may be installed in an inverted configuration, as illustrated in FIG. 6A, so that pneumatic disks 504 may be deactivated to a fully retracted position while functioning as stationary platforms for the physical training device during a training or exhibition event. In such an instance, casters 122 are inverted and, therefore, do not engage the supporting surface when pneumatic disks 504 are deactivated to a fully retracted position. In other embodiments, pneumatic disks 504 may remain in their fully retracted positions while casters 122 are installed in the mobility configuration of FIG. 6B, but are locked to prevent rotation, so as to function as stationary platforms for the physical training device during a training or exhibition event.

In a first embodiment, pneumatic discs 504 may be inflated/deflated using a combination of air compressor (not shown) and intake/exhaust valve (not shown), and air tubing (not shown), so as to effectuate the raising and lowering of the physical training device as discussed above. Furthermore, the air compressor and intake/exhaust valve may be actuated manually, or via remote control, whereby in a first mode of operation, the intake/exhaust valve is configured as an intake valve and the compressor is actuated to inflate pneumatic disk 504, thus raising the physical training device in direction 512. Alternately, the intake/exhaust valve may be configured as an exhaust valve, thus lowering the physical training device in direction 510.

It should be noted that placement of the compressor and the intake/exhaust valve may be on surface 522, or may be placed in any other convenient location where concealment and protection of the compressor and the intake/exhaust valve may be optimized. Air tubing may be routed to pneumatic disks 504 from the compressor and the intake/exhaust valve using the cavities of frame arrangement 300, such as hollow portions 310, 312 and/or channels 302, as discussed above in relation to FIG. 3A.

Figure 7A:
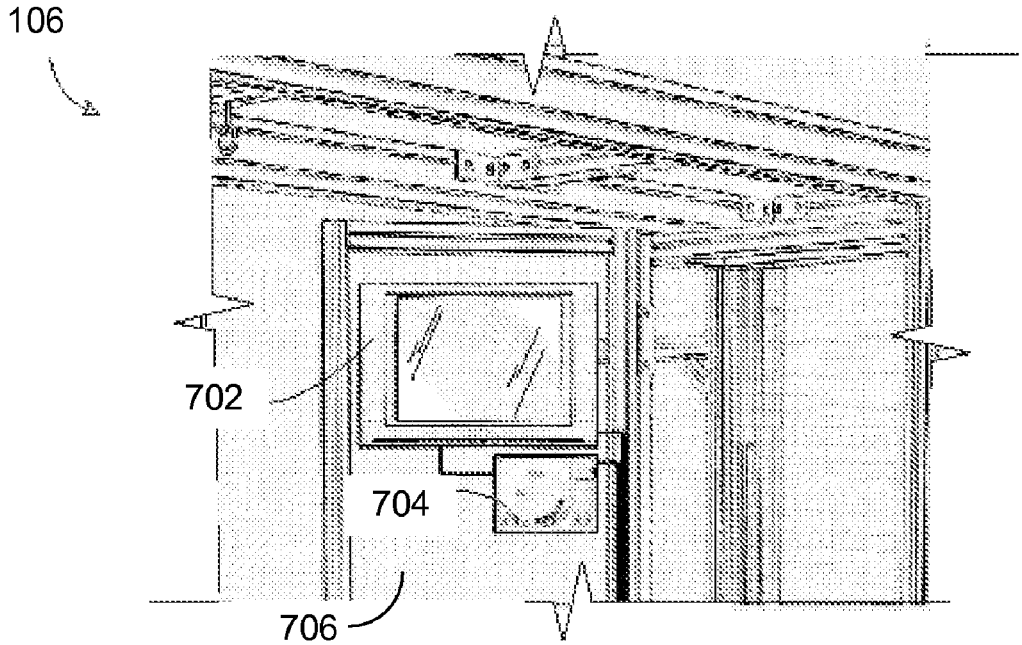
FIG. 7A illustrates interior features of the equipment cage of a physical training device in accordance with one embodiment of the present invention.

Turning to FIG. 7A, a portion of the interior features of equipment cage 106 of FIG. 1 are illustrated. In particular, a media center comprised of, for example, media player 704 and display device 702 may be housed within equipment cage 106 as illustrated. Media player 704 may include one or more data storage devices, including hard and floppy disk drives, CD/DVD drives, and other hardware capable of accessing stored data and/or audio/video information. Media player 704 is coupled to display device 702, which may be any type of known display or presentation screen, such as an LCD display, plasma display, cathode ray tube (CRT), etc.

In operation, the media center may be used by the one or more athletes as an audio/visual aid during execution of their respective workout scenarios. The training information provided by the media center may be consumed either while door 706 of equipment cage 106 is open, or conversely, while door 706 of equipment cage 106 is closed. Consumption of audio/video information while door 706 remains closed is made possible by the wire mesh configuration of equipment cage 106, which allows the audio/video information to egress equipment cage 106 even while the door of equipment cage 106 remains closed.

Figure 7B:
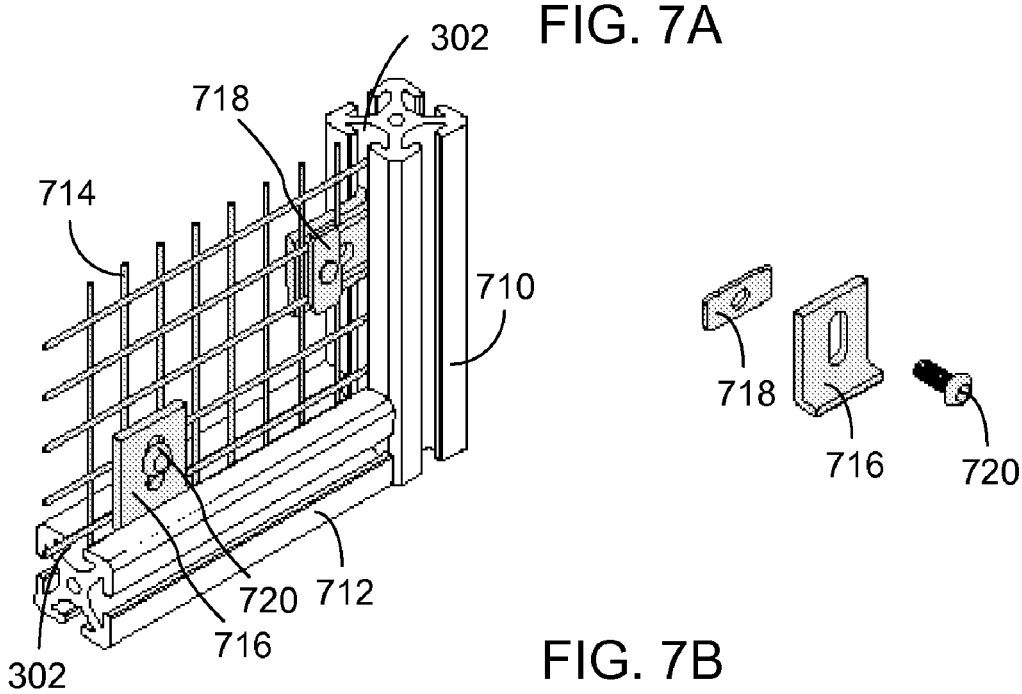
FIG. 7B illustrates mechanical details of the equipment cage of FIG. 7A in accordance with one embodiment of the present invention.

The wire mesh configuration of equipment cage 106 is further illustrated in FIG. 7B, whereby wire mesh 714 may be comprised of powder coated steel. Mechanical fasteners 716-720 may be utilized to secure wire mesh 714 into the channels 302 of frame members 710 and 712 as illustrated. In particular, bracket 716 may be locked into channels 302 by engaging the right angled portion of bracket 716 into channels 302. Fasteners 718 and 720 may then be mechanically engaged so as to clamp wire mesh 714 to bracket 716 to complete the assembly of wire mesh 714 within frame members 710 and 712 as illustrated.

Figure 8:
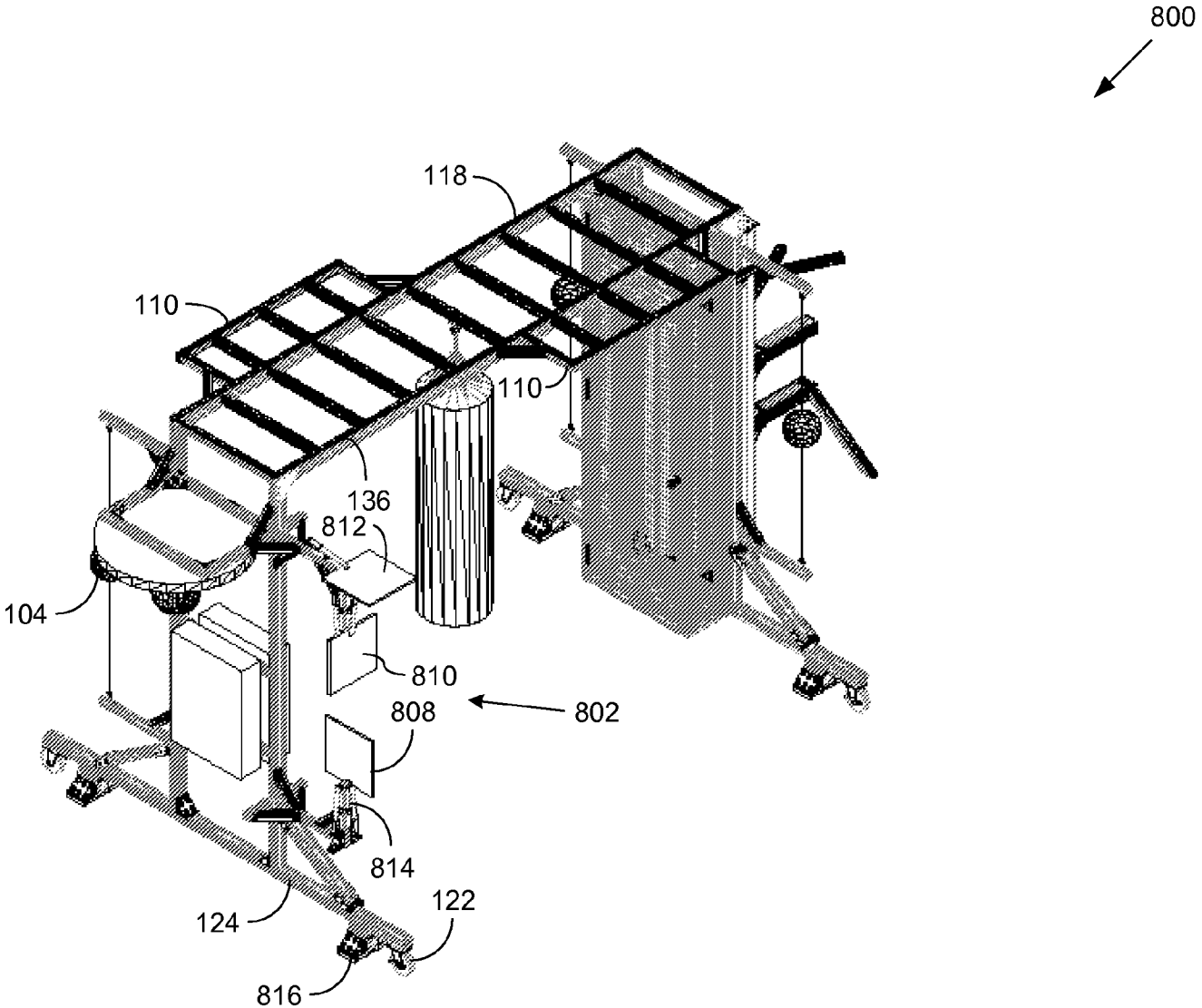
FIG. 8 illustrates a physical training device in accordance with an alternate embodiment of the present invention.

Turning to FIG. 8, an alternate embodiment of a physical training device is illustrated, whereby multiple pull-up bar stations 110 are configured along longitudinal frame member 118 and 136 as illustrated. Furthermore, additional workout stations, such as strike board station 802 and speed-ball stations 104 round out the complement of workout stations that may be configured at each corner of physical training device 800. In addition, physical training device 800 is configured with the lifting mechanisms as discussed above in relation to FIG. 5. It should be noted, that the physical training devices of FIGS. 1 and 8 are merely representative of a plurality of configurations that may be implemented. It is understood, therefore, that various other configurations may be similarly implemented in accordance with the particular workout regimes that may be required to be executed of physical training devices.

Strike board station 802, for example, may be comprised of multiple strike boards 808-812 that are arranged in various configurations depending upon the particular strike training regime that is to be employed. Strike boards 808 and 810, for example, may facilitate a strike training regime to improve the execution of front kicks, side kicks, roundhouse kicks, front punches, reverse punches, etc. Strike board 812 may be used to further improve the flexibility of the athlete, since either foot or hand of the athlete is required to contact strike board 812 despite the fact that the position of strike board 812 is adjusted, for example, above the head of the athlete.

Frame members utilized for the support of strike boards 808-812 may be comprised of frame arrangement 300, as discussed above in relation to FIG. 3A, whereby clamp members 814 may be slidably attached to one or more sides of the frame members so as to allow strike boards 808-812 to be temporarily mounted at various angles with respect to physical training device 800. That is to say, in other words, that while strike board 808 may be temporarily attached to strike-board station 802 to be substantially parallel with lateral frame member 124, as illustrated, strike board 808 may instead be temporarily attached to strike-board station 802 using clamp member 814 so as to rotate strike board 808 to be substantially orthogonal to lateral frame member 124.

Figure 9:
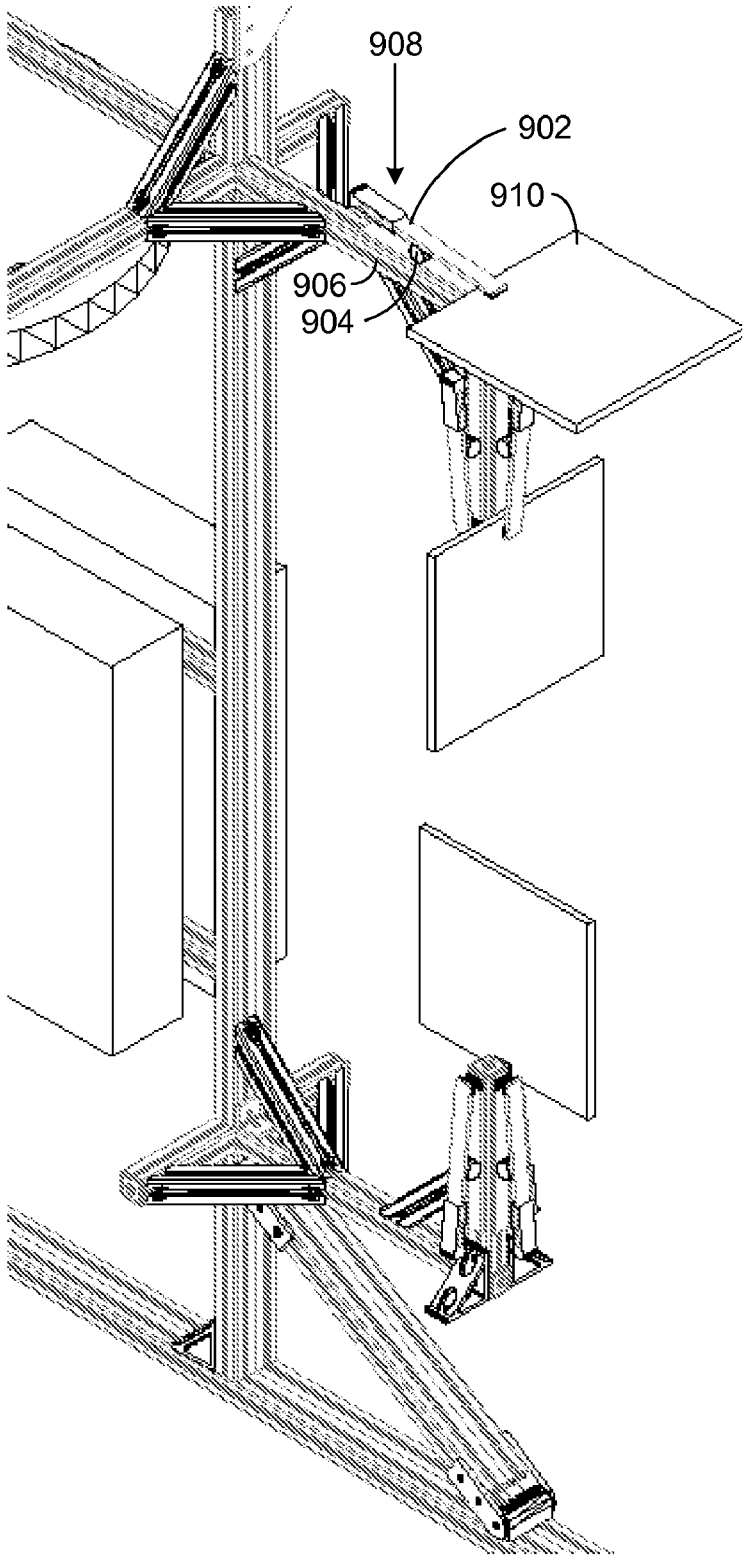
FIG. 9 illustrates an arrangement of clamp members used in a physical training device in accordance with one embodiment of the present invention.

Turning to FIG. 9, a close-up view of one embodiment of the arrangement of strike boards and associated clamp members is illustrated. Clamp members 814 may be comprised of lever 902 that is actuated by spring component 904 mounted between lever 902 and frame member 906 as illustrated. Applying downward force 908 on lever 902 allows the removal of strike board 910 and subsequent replacement of strike board 910 once strike board 910 is rendered unusable for its intended purpose. Release of downward force 908 allows clamp member 814 to apply a restraining force against strike board 910 to temporarily hold strike board 910 in place during a particular strike training regime.

Figure 10:
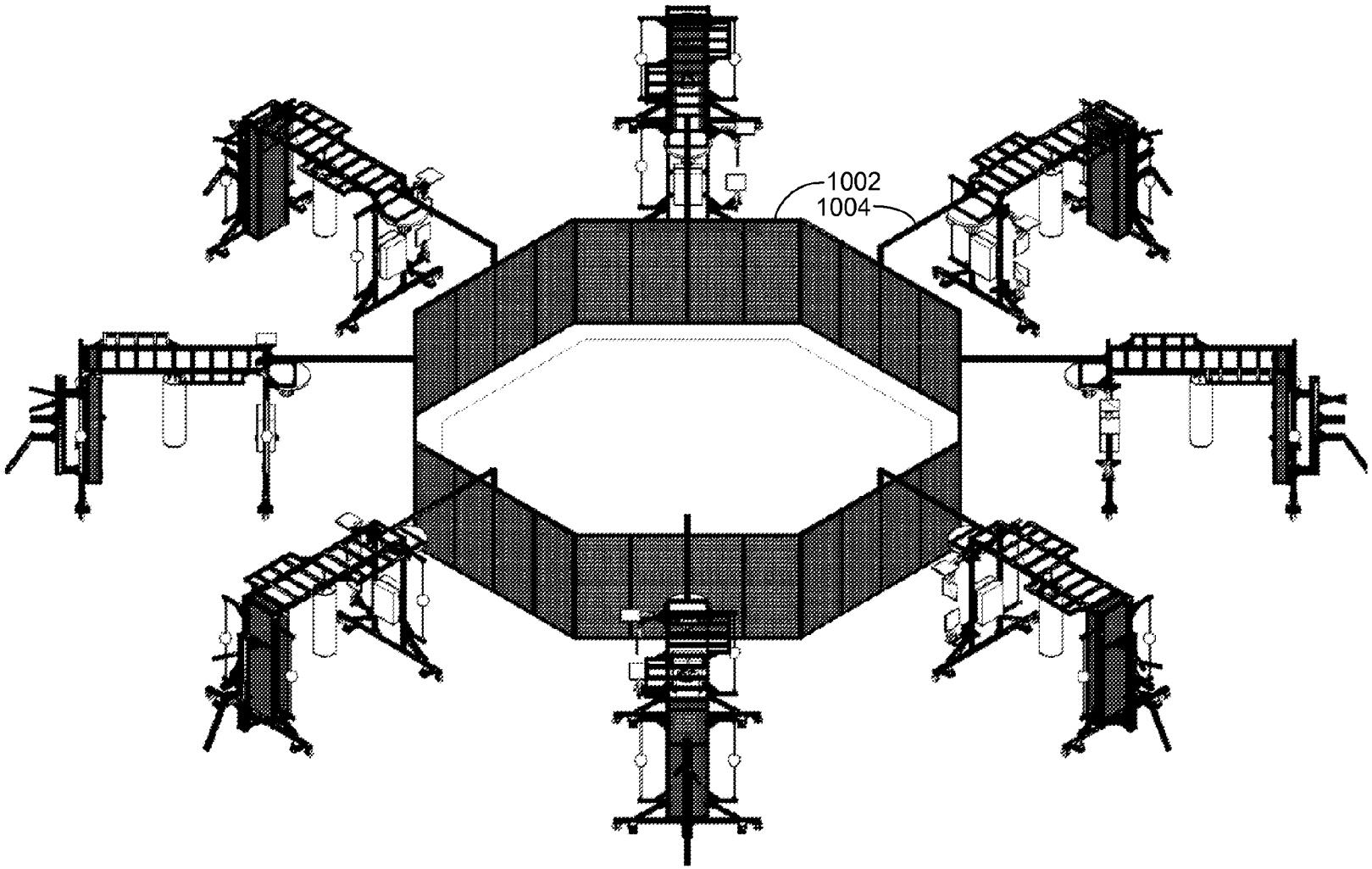
FIG. 10 illustrates a cluster arrangement of physical training devices in accordance with one embodiment of the present invention.

Turning to FIG. 10, an alternate embodiment is illustrated, whereby two or more physical training devices may be interconnected, so as to provide a localized cluster of physical training devices. In particular, any number of physical training devices, such as those described above in relation to FIGS. 1 and/or 8, may be interconnected using exhibition cage 1002. In such an instance, frame members 1004 are utilized to provide mechanical engagement with exhibition cage 1002, so as to form a substantially circular arrangement of physical training devices as illustrated.

As can be verified, a large number of athletes may be simultaneously accommodated by the cluster configuration of physical training devices of FIG. 10. In addition, the interior of exhibition cage 1002 may be accessed, so that while the multitude of athletes are simultaneously executing their respective workout scenarios on the cluster configuration of physical training devices, two or more athletes may be engaged in an exhibition/combat match within exhibition cage 1002.

It should be noted, that since the physical training devices described herein may be deployed in stand-alone configurations, exhibition cage 1002 is an optional component. That is to say, in other words, that virtually any other cluster configuration, i.e., non-circular, may be implemented using any number of physical training devices in their respective stand-alone configurations as required.

Figure 11:
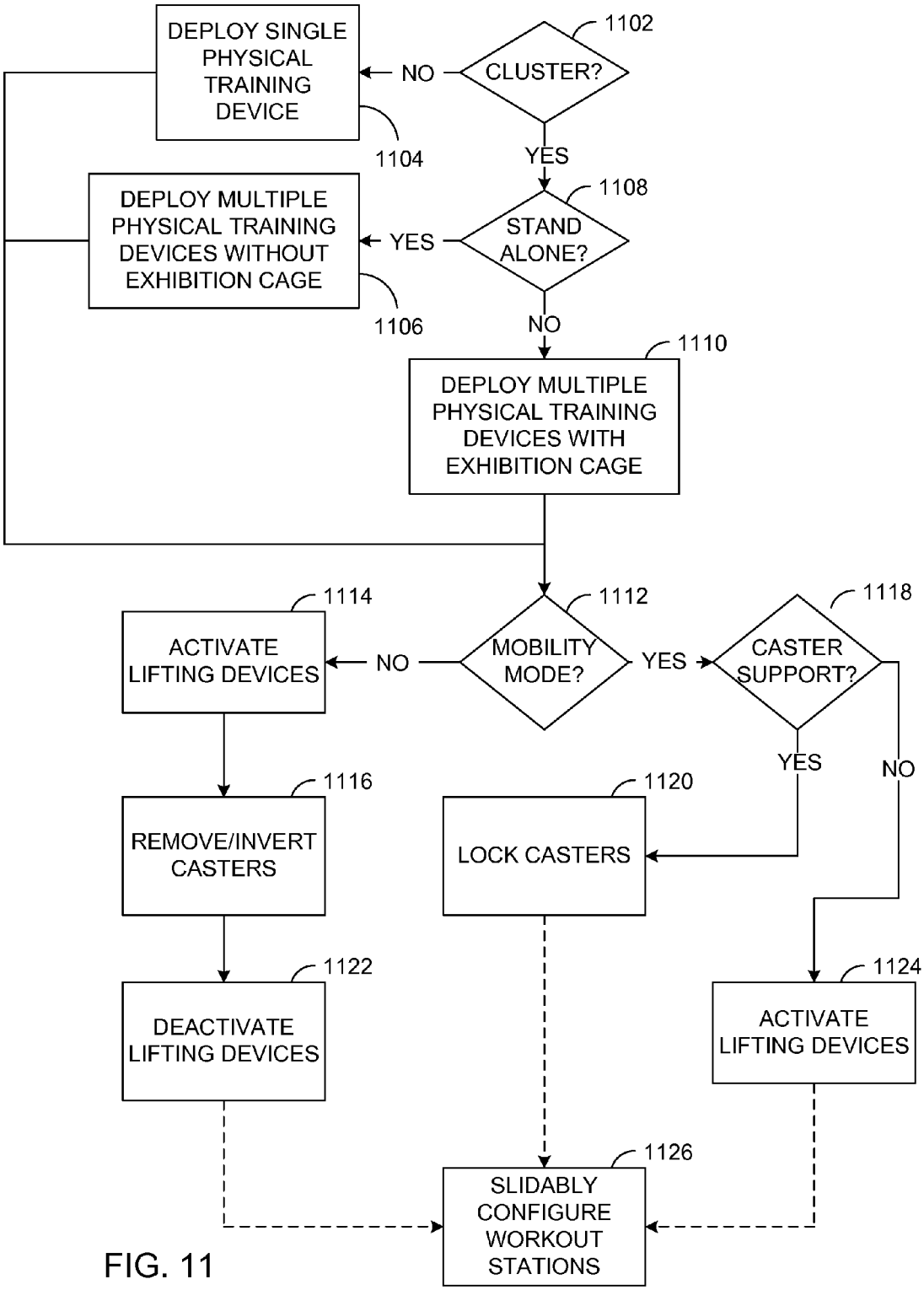
FIG. 11 illustrates a method of using one or more physical training devices in accordance with one embodiment of the present invention.

Turning to FIG. 11, a method of utilizing one or more of the physical training devices provided herein is illustrated. In step 1102, it is determined whether the physical training device is to be used by itself, or in conjunction with other physical training devices. If a single physical training device is to be utilized, then step 1104 provides that a single physical training device is to be deployed to locations such as gymnasiums, garages, rented or private facilities, parks, backyards, beaches, etc.

In order to facilitate the deployment of the physical training device, as in step 1104, removable casters, as discussed above in relation to FIG. 5, are provided at a bottom surface of the physical training device, so as to allow relocation and reconfiguration of the physical training device. The removable casters may be composed of a sufficiently rigid material, such as solid rubber or polyurethane, and appropriately sized so as to facilitate movement of the physical training device across a relatively hard and flat surface, such as a gymnasium floor. In an alternate embodiment, on the other hand, the removable casters may be composed of a sufficiently flexible material, e.g., air-filled rubber, and appropriately sized so as to facilitate movement of the physical training device across a substantially non-flat and soft surface, such as a sandy beach. It is understood that casters to be used across a non-flat, soft surface should be considerably larger in diameter and considerably more flexible as compared to the solid rubber casters as discussed above.

If, on the other hand, more than one physical training device is to be utilized, then step 1108 determines whether the cluster of physical training devices are to be utilized in a substantially circular configuration, or whether the cluster of physical training devices are to be utilized in a substantially random configuration. If a random configuration is desired, then step 1106 is executed, whereby stand-alone configurations of each physical training device are deployed randomly as may be required by the particular application. If a substantially circular configuration is desired, then step 1110 is executed, whereby in one embodiment, each physical training device is mechanically engaged to an exhibition cage, as discussed above in relation to FIG. 10.

Once each physical training device is deployed, then the mobility mode of each physical training device is determined as in step 1112. In particular, if the mobility mode for each physical training device is to be deactivated, as determined in step 1112, then lifting devices, such as pneumatic disks 504 may be activated in step 1114 to hoist the physical training device off of the associated supporting surface. In step 1116, casters 122 may then be removed, or configured into an inverted configuration, as discussed above in relation to FIG. 6A. In step 1122, pneumatic disks 504 may then be deactivated to a fully retracted position to function as stationary platforms for the physical training device as in step 1122. In such an instance, casters 122 are either inverted or removed and, therefore, do not engage the supporting surface when pneumatic disks 504 are deactivated to a fully retracted position.

If, on the other hand, the mobility mode for each physical training device is to remain activated, as determined in step 1112, then either casters 122 or support members 506/508 provide support for the physical training device as determined in step 1118. If casters 122 are to provide support, as determined in step 1118, then locking mechanism 502 is engaged in step 1120, as discussed above in relation to FIG. 5, to prevent casters 122 from rotating. Otherwise, pneumatic disks 504 are fully activated in step 1124, while casters 122 remain in the mobility configuration of FIG. 6B, so that support members 506/508 may provide support for the physical training device.

In optional step 1126, the use of slidably attached mechanisms, as discussed above, are used to configure the correct positioning of the various workout stations of the physical training device(s) if necessary. It should be noted, however, that the correct positioning of the various workout stations of the physical training device(s) may be selected prior to execution of steps 1102-1124, thus making step 1126 an optional execution step if correct positioning has already been implemented. The support platform of a speed-bag station, for example, may be slidably configured to the associated vertical frame members, so as to select the correct height of the speed-bag station. The support platforms of the body shield and speed-ball stations may also be slidably attached to respective frame members so as to properly adjust their height as well. The various strike boards of the physical training device may be similarly configured using slidable adjustments, whereby the orientation of the strike boards may be further configured using associated clamp members. Once usage of the physical training device(s) has terminated, then the mobility aspects of each physical training device may be reactivated for relocation of the physical training devices as required.

Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A physical training device, comprising:

a pair of longitudinal frame members having a first pair of channels;

a first pair of vertical frame members having a first end coupled to a first end of the pair of longitudinal frame members;

a second pair of vertical frame members having a first end coupled to a second end of the pair of longitudinal frame members, the first and second pairs of vertical frame members having second and third pairs of channels;

a first plurality of workout stations slidably coupled to the first and second pair of vertical frame members, wherein the first plurality of workout stations are configurably fastened along a length of the second and third channels;

a second plurality of workout stations slidably coupled to the pair of longitudinal frame members, wherein the second plurality of workout stations are configurably fastened along a length of the first pair of channels;

a first lateral frame member having a first surface coupled to a second end of the first pair of vertical frame members;

a second lateral frame member having a first surface coupled to a second end of the second pair of vertical frame members;

a plurality of lifting devices coupled to a second surface of the first and second lateral frame members, each of the plurality of lifting devices including a pneumatic disk, wherein the pneumatic disk is inflated to raise the physical training device and deflated to lower the physical training device; and a mobility device coupled to each end of the first and second lateral frame members.

2. The physical training device of claim 1, wherein the first plurality of workout stations comprises a Wing Chun station.

3. The physical training device of claim 2, wherein the Wing Chun station comprises:

a frame component;

one or more arm components slidably coupled to the frame component;

a mid-section component slidably coupled to the frame component; and a leg component slidably coupled to the frame component.

4. The physical training device of claim 3, wherein the leg component comprises:

an upper leg component slidably coupled to the frame component;

a joint component coupled to the upper leg component; and a lower leg component coupled to the joint component.

5. The physical training device of claim 1, wherein the first plurality of workout stations comprises one or more speed-ball stations.

6. The physical training device of claim 1, wherein the first plurality of workout stations comprises one or more speed-bag stations.

7. The physical training device of claim 1, wherein the first plurality of workout stations comprises a body-shield station.

8. The physical training device of claim 1, wherein the first plurality of workout stations comprises a strike-board station.

9. The physical training device of claim 1, wherein the second plurality of workout stations comprises a heavy punching bag station.

10. The physical training device of claim 1, wherein the second plurality of workout stations comprises a monkey-bar station.

11. The physical training device of claim 10, wherein the monkey-bar station comprises a plurality of third lateral frame members coupled between the pair of longitudinal frame members.

12. The physical training device of claim 11, wherein each of the plurality of third lateral frame members comprises one or more hand guards.

13. The physical training device of claim 12, wherein the one or more hand guards is comprised of a plastic material.

14. A cluster of physical training devices, comprising:

a cage; and a plurality of physical training devices coupled to the cage, each of the plurality of physical training devices comprising:

a pair of longitudinal frame members;

a first pair of vertical frame members having a first end coupled to a first end of the pair of longitudinal frame members;

a second pair of vertical frame members having a first end coupled to a second end of the pair of longitudinal frame members;

a first plurality of workout stations slidably coupled to the first and second pair of vertical frame members;

a second plurality of workout stations slidably coupled to the pair of longitudinal frame members;

a first lateral frame member having a first surface coupled to a second end of the first pair of vertical frame members;

a second lateral frame member having a first surface coupled to a second end of the second pair of vertical frame members; and a plurality of lifting devices coupled to a second surface of the first and second lateral frame members, each of the plurality of lifting devices including a pneumatic disk, wherein the pneumatic disk is inflated to raise the physical training device and deflated to lower the physical training device.

15. The cluster of physical training devices of claim 14, wherein the first plurality of workout stations comprises:

a Wing Chun station;

one or more speed-ball stations;

one or more speed-bag stations;

a body-shield station; and a strike-board station.

16. The cluster of physical training devices of claim 14, wherein the second plurality of workout stations comprises:

a heavy punching bag station; and a monkey-bar station.

* * * * *